US006593073B1

(12) United States Patent
Eikenberry et al.

(10) Patent No.: US 6,593,073 B1
(45) Date of Patent: Jul. 15, 2003

(54) CORE/SHELL EMULSIONS WITH ENHANCED PHOTOGRAPHIC RESPONSE

(75) Inventors: Jon N. Eikenberry, Rochester, NY (US); Yun C. Chang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/467,613

(22) Filed: Dec. 20, 1999

(51) Int. Cl.[7] ..... G03C 1/005; G03C 1/08

(52) U.S. Cl. ..... 430/581; 430/467; 430/469; 430/599; 430/600; 430/603; 430/607; 430/611; 430/613; 430/583

(58) Field of Search ..... 430/567, 569, 430/599, 600, 603, 607, 611, 613, 583, 581

(56) References Cited

U.S. PATENT DOCUMENTS

| | | | | | |
|---|---|---|---|---|---|
| 4,184,877 | A | | 1/1980 | Maternaghan | |
| 4,668,614 | A | | 5/1987 | Takada et al. | |
| 4,728,602 | A | | 3/1988 | Shibahara et al. | |
| 4,810,626 | A | | 3/1989 | Burgmaier et al. | |
| 4,963,467 | A | | 10/1990 | Ishikawa et al. | |
| 5,049,485 | A | | 9/1991 | Deaton | |
| 5,106,725 | A | * | 4/1992 | Matsuzaka et al. | 430/567 |
| 5,478,716 | A | * | 12/1995 | Sekiya et al. | 430/567 |
| 5,747,235 | A | | 5/1998 | Farid et al. | |
| 5,747,236 | A | * | 5/1998 | Farid et al. | 430/583 |
| 5,750,327 | A | | 5/1998 | Chang et al. | |
| 5,851,753 | A | * | 12/1998 | Yamada et al. | 430/603 |
| 6,054,260 | A | * | 4/2000 | Adin et al. | 430/583 |
| 6,153,371 | A | * | 11/2000 | Farid et al. | 430/581 |
| 6,242,170 | B1 | * | 6/2001 | Pepe et al. | 430/553 |
| 6,306,570 | B1 | * | 10/2001 | Adin et al. | 430/583 |
| 6,428,947 | B1 | * | 8/2002 | Johnston et al. | 430/505 |

FOREIGN PATENT DOCUMENTS

| | | | |
|---|---|---|---|
| EP | 0424923 A | | 5/1991 |
| EP | 786692 | * | 1/1997 |
| EP | 0786691 A1 | | 7/1997 |

* cited by examiner

*Primary Examiner*—Mark F. Huff
*Assistant Examiner*—Amanda C. Walke
(74) *Attorney, Agent, or Firm*—Lynne M. Blank

(57) ABSTRACT

A silver halide photographic element comprises at least one silver halide emulsion layer comprising a silver halide emulsion comprising core/shell silver halide grains wherein the core region comprises silver bromide with from about 5 to about 20% silver iodide and the shell region comprises silver bromide with about 0.1 to about 10% silver iodide and said layer contains a fragmentable electron donor compound of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7$V.

22 Claims, No Drawings

CORE/SHELL EMULSIONS WITH ENHANCED PHOTOGRAPHIC RESPONSE

FIELD OF THE INVENTION

This invention relates to the use of a fragmentable electron donor with core/shell, light-sensitive, silver halide emulsions.

BACKGROUND OF THE INVENTION

Core/shell bromoiodide emulsions containing high iodide regions have long been a staple of the blue-sensitive layer in color film. Their intrinsic light absorption in the blue region together with their low response to pressure, continue to make them an attractive choice, especially as the fast component. Recent techniques have been developed to improve the photographic performance of such emulsions by introducing twin planes (Maternaghan in U.S. Pat. No. 4,184,877), producing grains with a particular iodide architecture (Takada et al in U.S. Pat. No. 4,668,614, Ishikawa et al in U.S. Pat. No. 4,963,467), narrowing the range of iodide in individual grains (Shibahara et al in U.S. Pat. No. 4,728,602), and growing grains free of renucleation while obtaining a narrow distribution of grains with a high iodide content (Chang et al, U.S. Pat. No. 5,570,327). All of these methods suffer, however, from various disadvantages such as requiring a seed emulsion which has been previously prepared, producing a small yield of emulsion, or requiring excessive growth times. Furthermore, many of these emulsions derive increased photographic response from a narrow size distribution of grains which inherently leads to less latitude in response to light.

PROBLEM TO BE SOLVED BY THE INVENTION

There is, thus, a need for a readily prepared, high-iodide, core/shell emulsion of increased photographic response.

SUMMARY OF THE INVENTION

One aspect of this invention comprises a silver halide photographic element comprising at least one silver halide emulsion layer comprising core/shell silver halide grains wherein the core region comprises silver bromide with from about 5 to about 20% silver iodide and the shell region comprises silver bromide with about 0.1 to about 10% silver iodide and said layer contains a fragmentable electron donor compound of the formula X—Y' or a compound which contains a moiety of the formula —X—Y';
wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and
2) the oxidized form of X—Y' undergoes a bond cleavage reaction to give the radical $X^{\bullet}$ and the leaving fragment Y'; and, optionally,
3) the radical $X^{\bullet}$ has an oxidation potential $\leqq -0.7$V (that is, equal to or more negative than about −0.7V).

ADVANTAGEOUS EFFECT OF THE INVENTION

This invention provides a photographic element comprising a silver halide emulsion having a high intrinsic light absorption in the blue region with a low sensitivity to pressure and an increased photographic response. Further, the emulsion can be readily prepared without a seed emulsion and can be produced in high yield in a short time.

All percentages specified herein are mole %, unless indicated to the contrary.

DETAILED DESCRIPTION OF THE INVENTION

This invention also provides a high-iodide emulsion with increased photographic response which is especially useful in the blue record of color film. The enhanced speed of the emulsion induced by the fragmentable electron donor allows the use of an emulsion which is readily formed in good yield in a short run time without the need of nucleating seeds. Because the emulsion is, polydisperse it has a wide latitude allowing lower silver coverages in color film.

Useful emulsions in this application include bromide emulsions with core regions containing from 5–20% iodide. Especially useful are those emulsions with cores of from 8–18% iodide. The core is suitably 20–60% of the total grain volume. Especially useful are those with a core of 30–50%. The shell region can be 0–10% iodide but in all cases, the iodide in the shell is less than that in the core. Especially useful are emulsions with a shell comprising from 2–8% iodide. The total iodide of the emulsion can range from 2–15%. Iodide analysis can be performed using X-ray powder diffraction as described by Blanton in *Industrial Applications of X-Ray Diffraction*, Chapter 25, 1999.

Bromoiodide emulsions have been the mainstay of photographic films for many years. Illingsworth in U.S. Pat. No. 3,320,069 disclosed the utility of bromoiodide emulsions prepared in the presence of thiocyanate. The preferred embodiment is based on such an emulsion although the manner of thiocyanate addition is not critical and, in the present invention, the iodide architecture has been refined.

In the following discussion of silver halide emulsions and their preparation, reference will be made to *Research Disclosure*, September 1996, Number 389, Item 38957, which will be identified hereafter by the term "*Research Disclosure I*." This and all other Research Disclosures referenced herein are published by Kenneth Mason Publications, Ltd., Dudley Annex, 12a North Street, Emsworth, Hampshire P010 7DQ, ENGLAND. The Sections hereafter referred to are Sections of the *Research Disclosure I* unless otherwise indicated.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in *Research Disclosure I*, Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The grain size of the core/shell silver halide may have any distribution known to be useful in photographic compositions.

The morphology of the core/shell silver halide may be octahedral, cubic, polymorphic, or tabular.

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

In accordance with this invention the silver halide emulsion contains a fragmentable electron donating (FED) compound which enhances the sensitivity of the emulsion. The fragmentable electron donating compound is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

Although generally preferred concentration ranges for the various SET, and non-SET Ir dopants have been set out above, it is recognized that specific optimum concentration ranges within these general ranges can be identified for specific applications by routine testing. It is specifically contemplated to employ the SET and non-SET Ir dopants singly or in combination. For example, grains containing a combination of an SET dopant and a non-SET Ir dopant are specifically contemplated. The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

2) the oxidized form of X—Y' undergoes a bond cleavage reaction to give the radical $X^{\bullet}$ and the leaving fragment Y'; and, optionally, 3) the radical $X^{\bullet}$ has an oxidation potential $\leqq -0.7V$ (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $X^{\bullet}$, which in a preferred embodiment undergoes further oxidation.

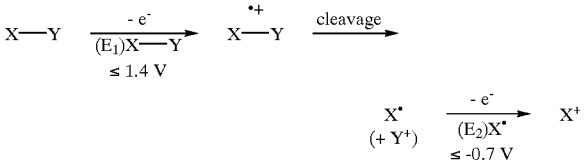

where $E_1$ is the oxidation potential of X—Y and $E_2$ is the oxidation potential of the radical $X^{\bullet}$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^{\bullet}$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^{\bullet}$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $X^{\bullet}$, which in a preferred embodiment undergoes further oxidation.

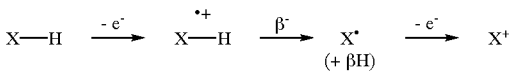

Preferred X groups are of the general formula:

(I)

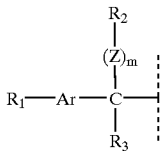

-continued (II)

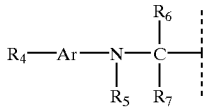

(III)

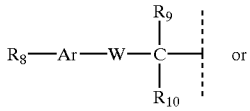

(IV)

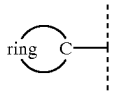

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to form 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev. Vol* 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

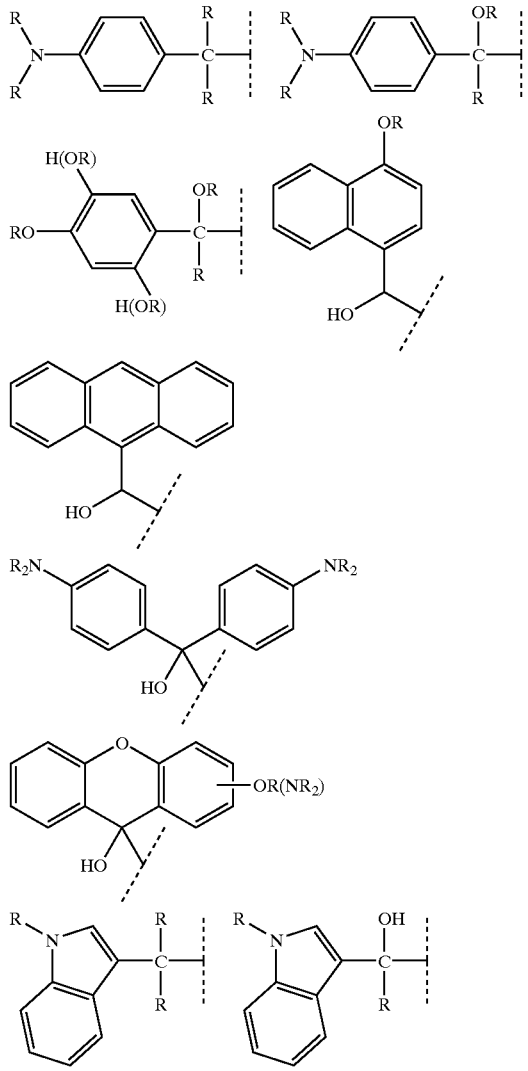

-continued

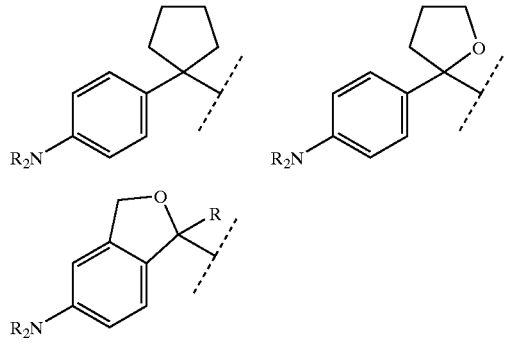

In the structures of this patent application a designation such as —OR($NR_2$) indicates that either —OR or —$NR_2$ can be present.

The following are illustrative examples of the group X of general structure

II:

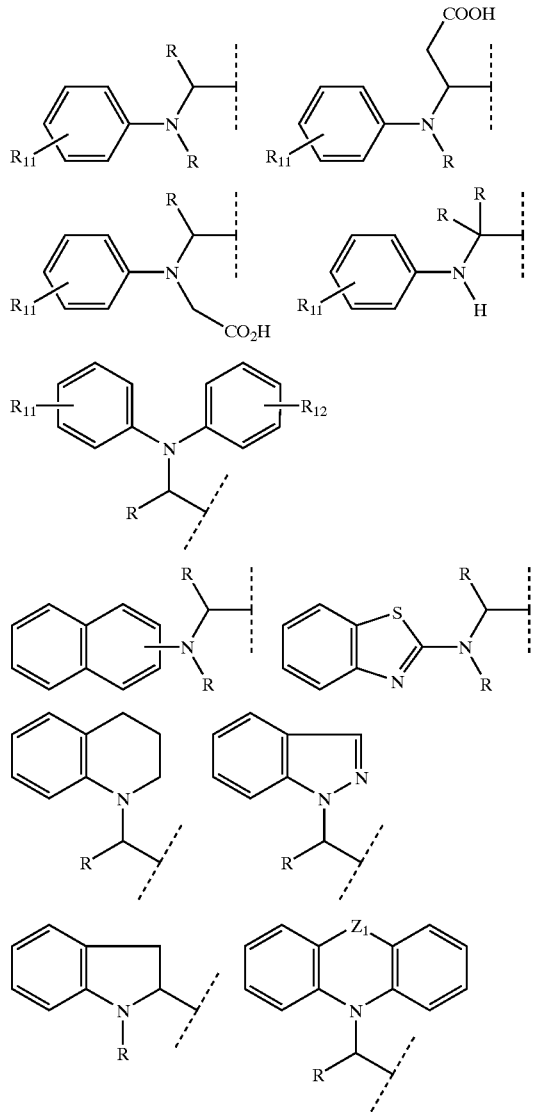

-continued $R_{11}$ and $R_{12}$ = { H, alkyl, alkoxy, alkylthio, halo, carbamoyl; carboxyl, amido, formyl, sulfonyl, sulfonamido, nitrile }

$Z_1$=a covalent bond, S, O, Se, NR, $CR_2$, CR═CR, or $CH_2CH_2$.

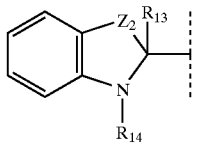

$Z_2$=S, O, Se, NR, $CR_2$, CR═CR, $R_{13}$, =alkyl, substituted alkyl or aryl, and $R_{14}$=H, alkyl substituted alkyl or aryl.

The following are illustrative examples of the group X of the general structure III:

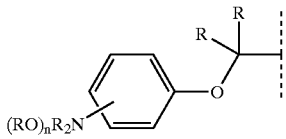

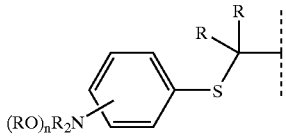

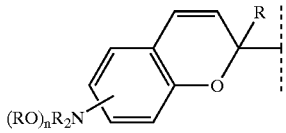

$n$ = 1–3

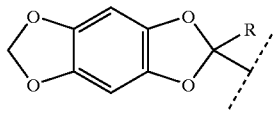

The following are illustrative examples of the group X of the general structure IV:

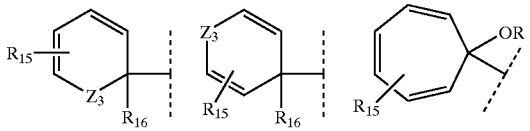

$Z_3$=O, S, Se, NR $R_{15}$=R, OR, $NR_2$ $R_{16}$=alkyl, substituted alkyl

Preferred Y' groups are:

(1) X', where X' is an X group as defined in structures I–IV and may be the same as or different from the X group to which it is attached (2)

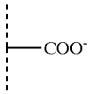

(3)

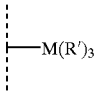

where M=Si, Sn or Ge; and R'=alkyl or substituted alkyl (4)

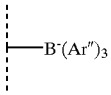

where Ar"=aryl or substituted aryl (5)

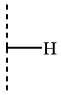

In preferred embodiments of this invention Y' is —H, —COO— or —Si(R')$_3$ or —X'. Particularly preferred Y' groups are —H, —COO— or —Si(R')$_3$.

In embodiments of the invention in which Y' is a proton, a base, $\beta^-$, is covalently linked directly or indirectly to X. The base is preferably the conjugate base of an acid of pKa between about1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | |
|---|---|
| $CH_3$—$CO_2^-$ | 4.76 |
| $C_2H_5$—$CO_2^-$ | 4.87 |
| $(CH_3)_2CH$—$CO_2^-$ | 4.84 |
| $(CH_3)_3C$—$CO_2^-$ | 5.03 |
| HO—$CH_2$—$CO_2^-$ | 3.83 |
| 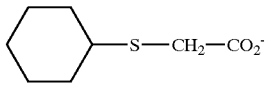 | 3.48 |
| $CH_3$—CO—NH—$CH_2$—$CO_2^-$ | 3.67 |
| 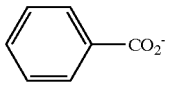 | 4.19 |
| 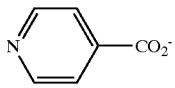 | 4.96 |
| $CH_3$—$COS^-$ | 3.33 |

TABLE I-continued

| pKa's in water of the conjugate acids of some useful bases | |
|---|---|
| 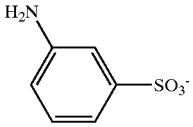 | 3.73 |
| 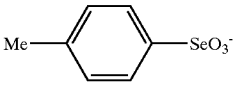 | 4.88 |
| 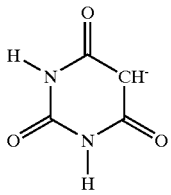 | 4.01 |
| 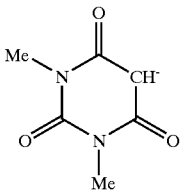 | 4.7 |
| 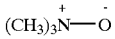 | 4.65 |
| 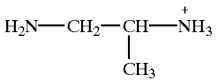 | 6.61 |
| 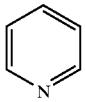 | 5.25 |
| 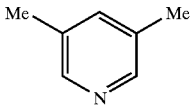 | 6.15 |
| 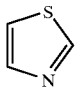 | 2.44 |
| 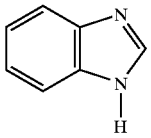 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absorptive group, A, directly or indirectly attached to X, or a chromophore forming group, Q, which is attached to X. Such fragmentable electron donating compounds are preferably of the following formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$

Z is a light absorbing group;

k is 1 or 2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

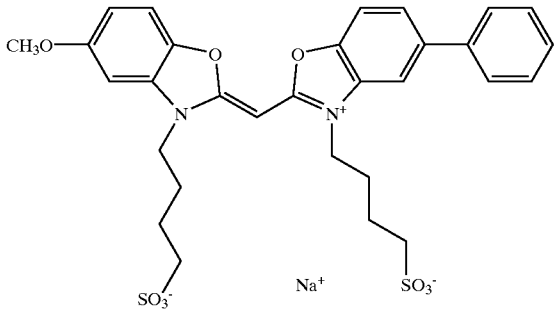

Dye 2

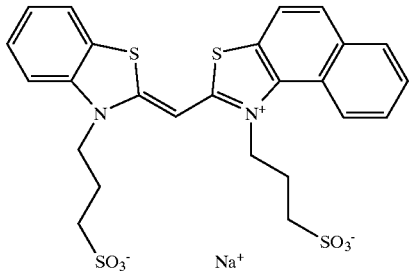

-continued

Dye 3

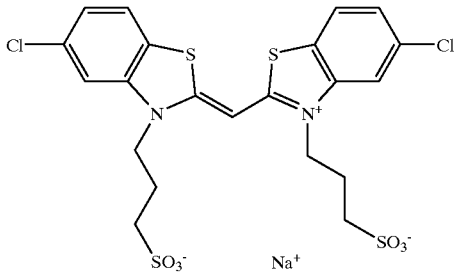

Dye 4

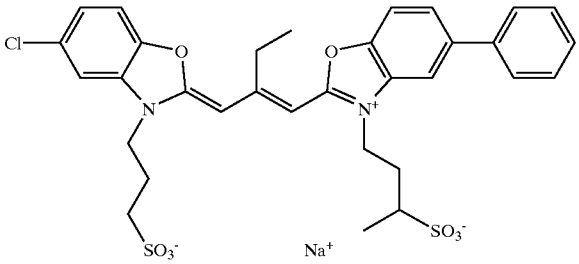

Dye 5

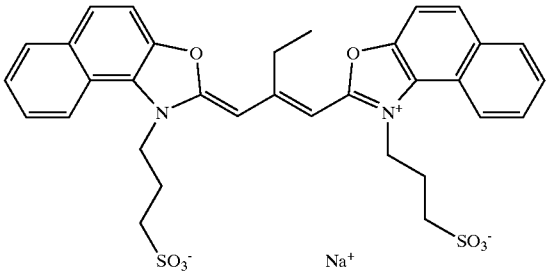

Dye 6

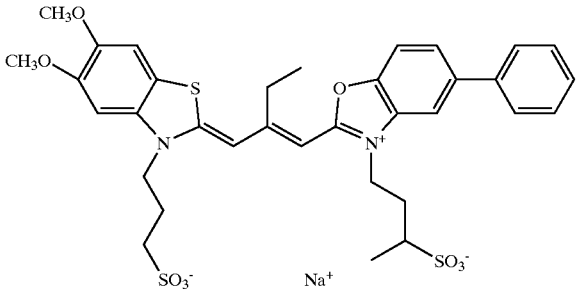

Dye 7

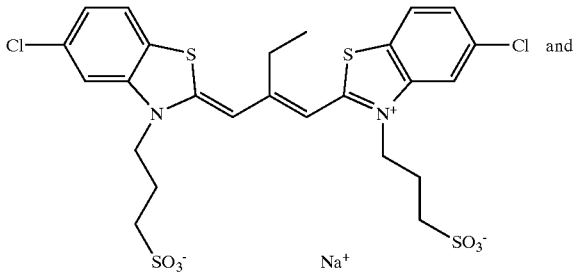

and

-continued

Dye 8

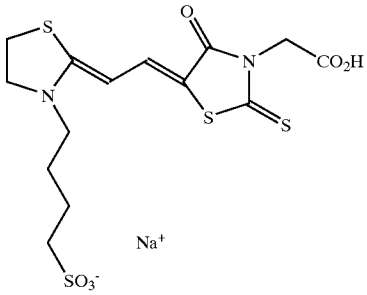

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

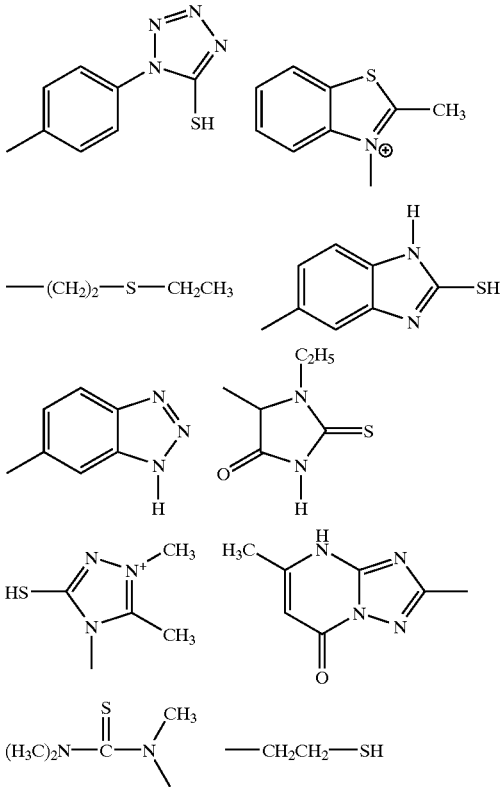

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects by a covalent bond the light absorbing group Z or the silver halide adsorbing group A to the fragmentable electron donating group XY is preferably an organic linking group containing a least one C, N, S, or O atom. It is also desired that the linking group not be completely aromatic or unsaturated, so that a pi-conjugation system cannot exist between the Z and XY or the A and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

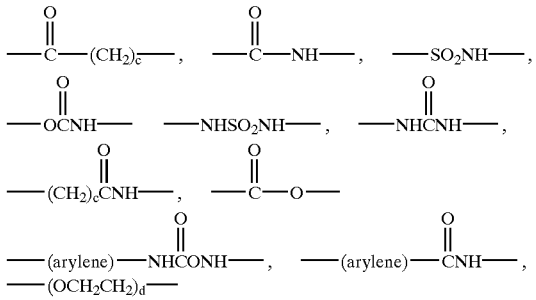

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

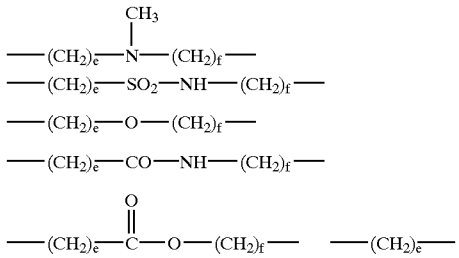

e and f=1–30, with the proviso that e+f≦31

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups include:

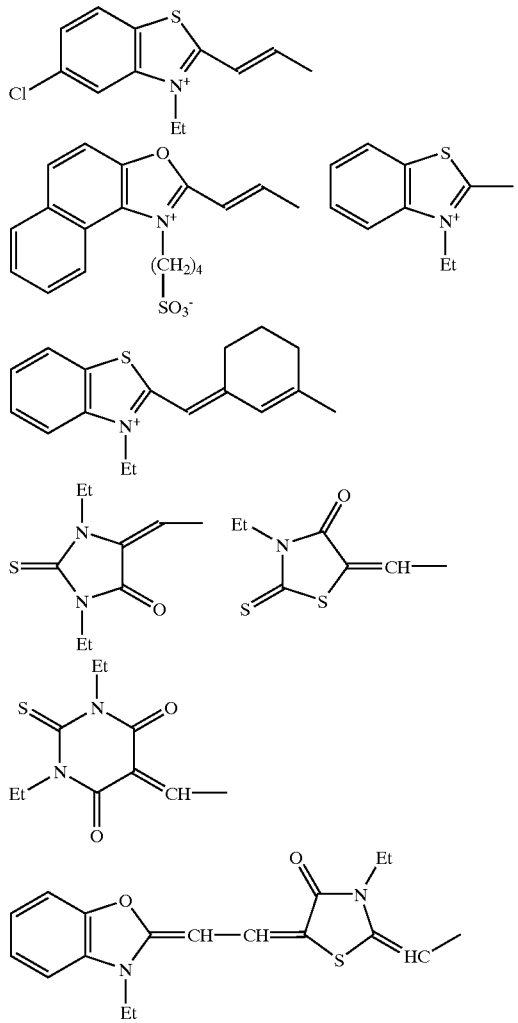

Particularly preferred are Q groups of the formula:

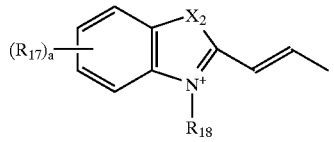

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1
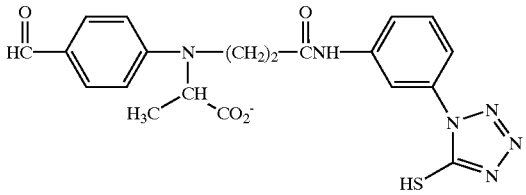
FED 2
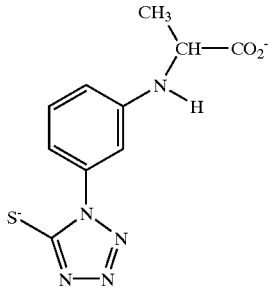
FED 3
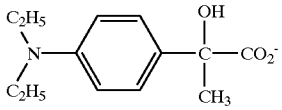
FED 4
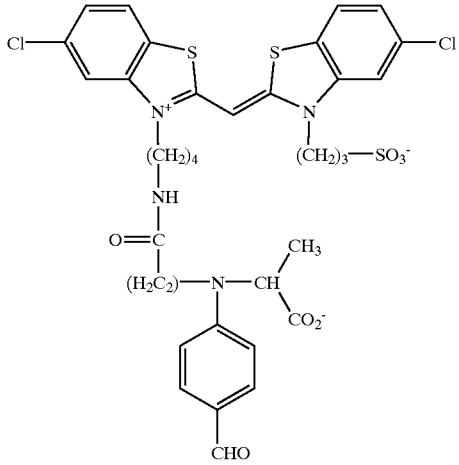
FED 5
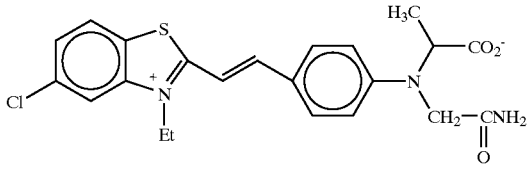
FED 6
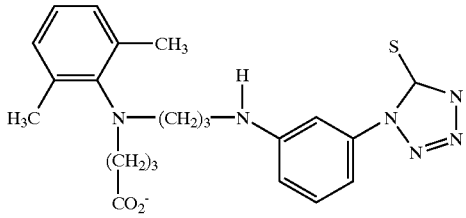
FED 7
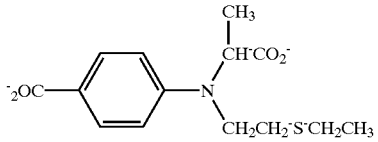
FED 8
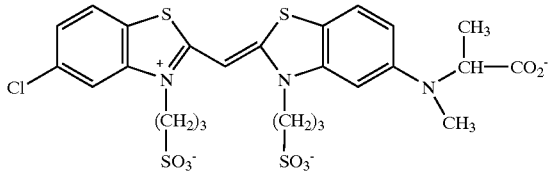
FED 9
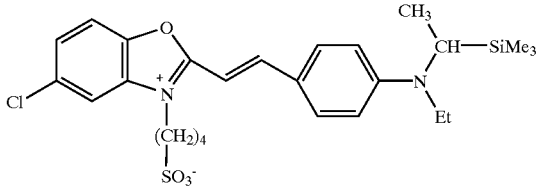
FED 10
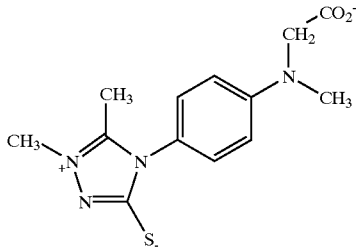

-continued
FED 11
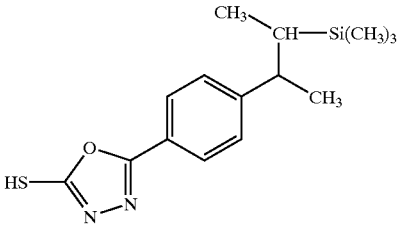
FED 12
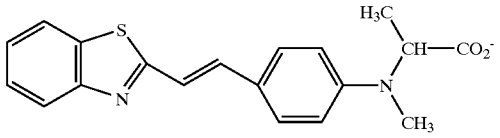
FED 13
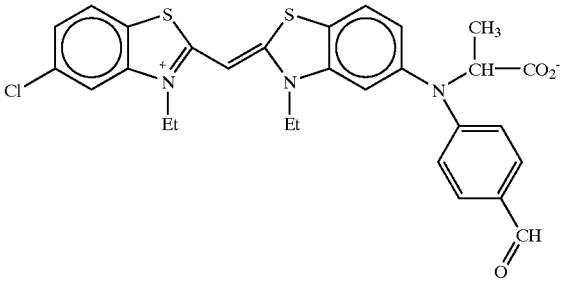
FED 14
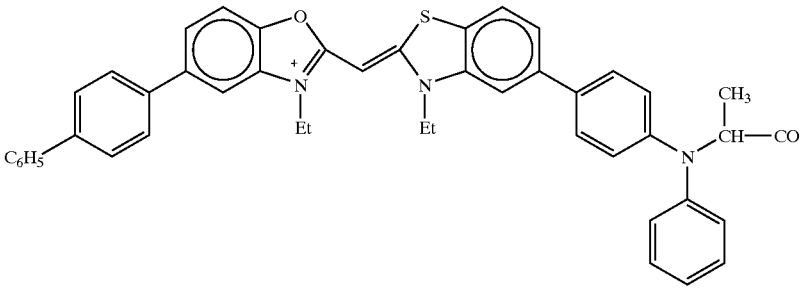
FED 15
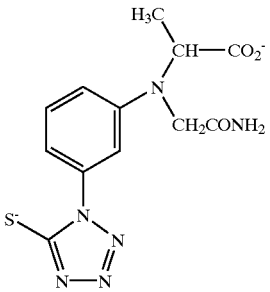
FED 16
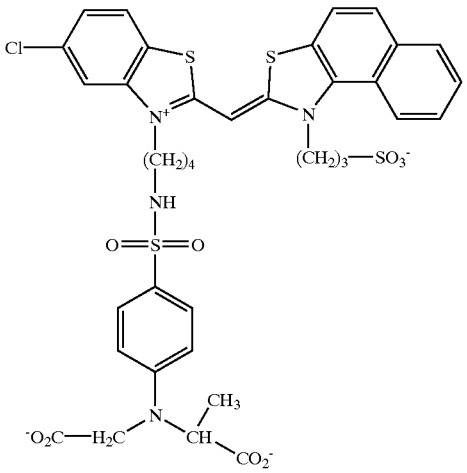

-continued

FED 17

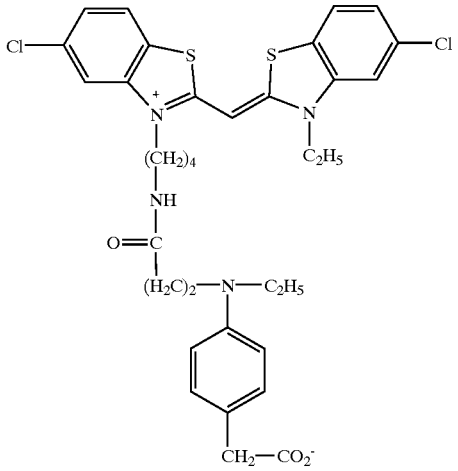

FED 18

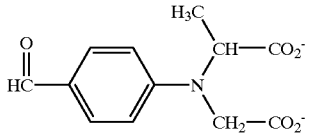

FED 18

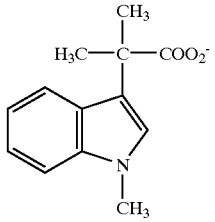

FED 20

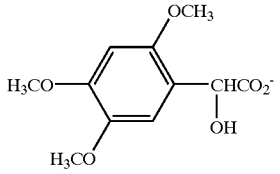

FED 21

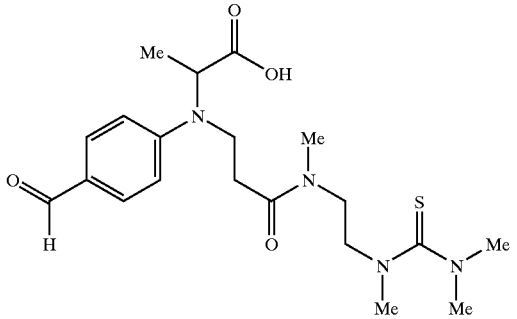

FED 22

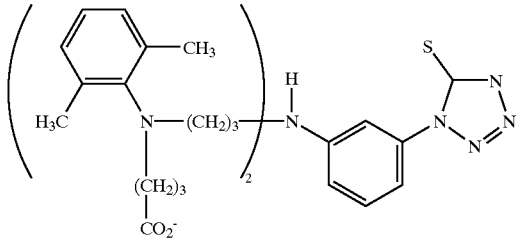

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235 and 5,747,236 and commonly assigned co-pending U.S. application Ser. No. 08/739,911 filed Oct. 30, 1996, and Ser. Nos. 09/118,536, 09/118,552 and 09/118,714 filed Jul. 25, 1998, the entire disclosures of these patents and patent applications are incorporated herein by reference.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Pat. No. 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716 incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide may be sensitized by sensitizing dyes by any method known in the art, such as described in *Research*

*Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines.

Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the preparation of emulsions and photographic elements in accordance with this invention.

Emulsion Preparation

Emulsion E-1

This is a core/shell emulsion prepared as follows: A reaction vessel with good mixing was charged with 3.53 kg of distilled water containing 36 g of sodium bromide, 36.2 g of deionized, lime-processed, bone gelatin, and antifoamant. After adjusting the temperature of the vessel to 35° C., 0.573 moles of silver iodide Lippmann seeds were added followed by a 4 min hold. An additional 0.448 moles of silver iodide seeds were added followed by another 4 min hold. Nucleation was conducted by the addition of 0.75 M silver nitrate at a linearly accelerated rate from 17.7 to 31.1 g/min for 9 min.

Growth was begun with the simultaneous addition of 0.75 M silver nitrate and 0.825 sodium bromide at linearly accelerated rates from 31.1 to 56.2 and 11.0 to 76.5 g/min, respectively, for 21.8 min. Growth was continued with 1.56 M silver nitrate and 2.41 sodium bromide being added at rates of from 29.2 to 33.0 and 20.8 g/min, respectively for 5.9 min, at rates of 33.0 to 87.7 and 20.8 to 80.4 g/min, respectively, for 25 min, and then at constant rates of 87.7 and 71.0 g/min, respectively, for 14.25 min. Silver nitrate only was added at 62.6 g/min for 12 min then silver nitrate and sodium bromide were added at 41.9 to 47.4 and 27.4 to 31.0 g/min, respectively, for 70 min controlling the vAg at 120 mV with adjustments in the sodium bromide flow. The vessel was cooled to 45° C. and excess salt was removed by ultrafiltration to yield 8 moles of a core/shell emulsion containing 8.2% iodide and with an average size of 1.10 um. X-ray diffraction analysis revealed a core region containing 35% iodide with additional iodide regions of 13, 8, and 2% iodide.

Emulsion E-2

This is a core/shell emulsion prepared in the following manner: Into a reaction vessel with good mixing was added 32.2 g of lime-processed, bone gelatin, 68 g of sodium bromide, 4.43 L of distilled water, and antifoamant. The vessel was brought to a temperature of 75° C., 0.421 moles of silver iodide Lippmann seeds were added, and the vessel was held with good mixing for 4 min. Nucleation was initiated with 0.5 M silver nitrate addition at 20 g/min for 9 s. The silver flow was then ramped to 40 g/min in 9 min.

Growth was conducted by simultaneously adding 0.5 M silver nitrate and 0.55 M sodium bromide at linearly accelerated flows from 0.4 to 0.7 and from 0.1 to 1.0 g/min, respectively, for 21.8 min. Growth was then continued with 1.25 M silver nitrate and 1.75 M sodium bromide at flows from 0.3 to 0.4 and a constant 0.3 g/min, respectively, for 5.9 min, from 0.4 to 1.1 and 0.3 to 1.0 g/min, respectively, for 25 min. The vAg was then driven to +40 mV by adding silver nitrate only from 1.1 to 1.4 g/min over 9 min, then from 1.4 to 0.8 g/min over 7.7 min. Silver nitrate and sodium bromide were then added at a constant rate of 0.5 and 0.4 g/min, respectively, for 13.9 min. Following cool down to 45° C., the emulsion was ultrafiltered to remove excess salt to yield 11.8 moles of a core/shell emulsion containing 13.9% iodide with an average size of 1.40 um. X-ray diffraction revealed a core of 39% iodide with three additional iodide regions of 15, 9, and 5% iodide.

Emulsion E-3

This is a core/shell emulsion prepared as follows: Into a reaction vessel with good stirring was added 5 L of distilled water, 166 g of lime-processed, bone gelatin, 545 g of sodium bromide, 50 g of potassium iodide and antifoamant. The vessel was brought to 80° C. and nucleation was conducted by adding 2.352 M silver nitrate containing 137 mg/l mercuric chloride at a linearly accelerated flow rate from 28.3 to 41.3 ml/min. 0.06 moles of ammonium sulfate were added followed by 0.126 moles of sodium hydroxide. After 1.5 min the ammonia was neutralized with 0.2 N sulfuric acid to pH 5.4. Growth was initiated with silver nitrate added simultaneously with a solution consisting of 1.963 M sodium bromide containing 1.474 M potassium iodide. Flow rates were ramped linearly from 41.3 to 85.0 and from 18.3 to 37.7 mL/min, respectively, for 30.7 min. For a period of 25.6 min the silver flow was held at 85.0 mL/min while the salt flow was ramped linearly from 19.3 to 50.0 mL/min using 3.905 M sodium bromide. 192 mg of ruthenium hexacyanide was then added over a period of 8.5 min while the silver flow remained at 85.0 mL/min and the salt flow increased from 50.1 to 60.3 mL/min. Growth was continued with the silver flow at 85.0 and the salt flow increasing from 60.3 to 77.0 mL/min. Following cool down to 45° C., the emulsion was ultrafiltered to remove excess salt yielding 14.9 moles with an average grain size of 2.20 um and containing 9.0% iodide. X-ray diffraction revealed a core of 24% iodide with three additional iodide regions of 20, 7, and 2% iodide.

Emulsion E-4

This is a core/shell emulsion prepared as follows: Into a reaction vessel with good mixing was added 6.8 L of distilled water, 196 g of lime-processed, bone gelatin, 233.2 g of sodium bromide, 34 g of potassium iodide and antifoamant and, while keeping the temperature at 53° C., an aqueous solution consisting of 1.405 M silver nitrate was added at the rate of 125 mL/min for 23.46 min simultaneously with the addition of a solution consisting of 2.466 M sodium bromide containing 0.154 M potassium iodide and added at the rate of 141.7 mL/min. The addition of halide solution was then terminated and the addition of silver nitrate solution was continued for an additional 23.46 min. The vessel temperature was raised to 76° C. over a period of 11.5 min and an aqueous solution of 19 g of sodium thiocyanate in 28 mL was then added. After a hold time of 25 min the vessel was cooled to 45° C. and the excess salts were removed by ultrafiltration. The yield was 8.24 moles of a core/shell emulsion containing 8.2% iodide and with an average size of 1.04 $\mu$m. X-ray diffraction analysis revealed a core region containing 14% iodide and a shell region containing 5% iodide.

Emulsion Sensitization

The chemical sensitization of each emulsion was formulated to give the optimum speed/fog performance.

EXAMPLE 1

Comparison

Emulsion E-1 was treated sequentially with yellow sensitizing dye, Dye 3; potassium chloride; sodium thiocyanate; aurous dithiosulfate; sodium thiosulfate; and finish modifier, FM (see chemical structures below). The emulsion was then incubated for 22 min at 62.5° C. Following cooling to 40° C., the emulsion was treated with antifoggant, AF-1.

EXAMPLE 2

Comparison

Emulsion E-1 was treated in a manner identical to Example 1 except 3.9 nmol/m$^2$ of FED 2 was added following AF-1. Example 3 (Comparison) Emulsion E-1 was treated in a manner identical to Example 1 except 7.7 nmol/m$^2$ of FED 2 was added following AF-1.

EXAMPLE 4

Comparison

Emulsion E-2 was treated sequentially with potassium chloride; sodium thiocyanate; yellow sensitizing dye, Dye 3; sodium thiosulfate; aurous dithiosulfate and finish modifier, FM. The emulsion was then incubated for 8 min at 66° C. Following cooling to 40° C., the emulsion was treated with antifoggant, AF-1.

EXAMPLE 5

Comparison

Emulsion E-2 was treated in a manner identical to Example 4 except 9.4 nmol/m$^2$ of FED 2 was added following AF-1.

EXAMPLE 6

Comparison

Emulsion E-2 was treated in a manner identical to Example 4 except 18.7 nmol/m$^2$ of FED 2 was added following AF-1.

EXAMPLE 7

Comparison

Emulsion E-3 was treated sequentially with potassium chloride; sodium thiocyanate; aurous dithiosulfate; sodium thiosulfate; and finish modifier, FM. The emulsion was then incubated for 25 min at 63° C. Following cooling to 40° C., the emulsion was treated with yellow sensitizing dye, Dye 3, followed by antifoggant, AF-1.

EXAMPLE 8

Comparison

Emulsion E-3 was treated in a manner identical to Example 7 except 13.2 nmol/m$^2$ of FED 2 was added following AF-1.

EXAMPLE 9

Comparison

Emulsion E-3 was treated in a manner identical to Example 7 except 26.5 nmol/m$^2$ of FED 2 was added following AF-1.

EXAMPLE 10

Comparison

Emulsion E-4 was treated sequentially with potassium chloride; sodium thiocyanate; finish modifier, FM; yellow sensitizing dye, Dye 3; gold sulfide; sulfur sensitizer, SS, as described by Burgmaier et al in U.S. Pat. No. 4,810,626; and gold sensitizer, GS, as described by Deaton in U.S. Pat. No. 5,049,485. The emulsion was then incubated for 12 min at 62° C. Following cooling to 40° C., the emulsion was treated with antifoggants, AF-2 and AF-1.

EXAMPLE 11

Invention

Emulsion E-4 was treated in a manner identical to Example 10 except 3.5 nmol/$m^2$ of FED 2 was added following AF-1.

EXAMPLE 12

Invention

Emulsion E-4 was treated in a manner identical to Example 10 except 7.0 nmol/$m^2$ of FED 2 was added following AF-1.

EXAMPLE 13

Invention

Emulsion E-4 was treated in a manner identical to Example 10 except 14.4 nmol/$m^2$ of FED 2 was added following AF-1.

Photographic Evaluation

The sensitized emulsion samples were coated in a simple single layer format which consisted of a pad of gelatin on a cellulose acetate film support with an antihalation backing covered by a layer containing the emulsion and the yellow image forming coupler, C-1, together with a yellow development inhibitor releasing coupler, C-2. The emulsion layer was protected from abrasion by a gelatin overcoat containing hardener. A detailed description of the layered structure is described in Table 2.

TABLE 2

Single Layer Format

| Coated Layer | Composition |
|---|---|
| Protective Overcoat | 2.15 g/$m^2$ gelatin |
| Emulsion/Coupler | 3.23 g/$m^2$ gelatin<br>0.86 g/$m^2$ Ag<br>1.08 g/$m^2$ coupler C-1<br>0.032 g/$m^2$ coupler C-2<br>0.004 g/$m^2$ antifoggant AF-1 |
| Gelatin Pad | 4.89 g/$m^2$ gelatin |
| Support | Cellulose Acetate |

Chemical Structures

SS

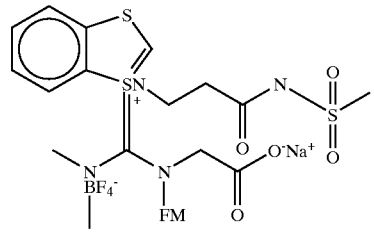

GS

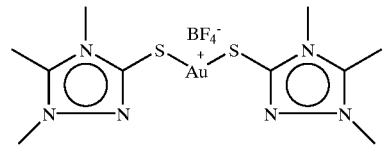

AF-1

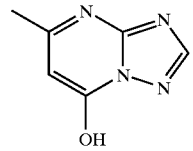

AF-2

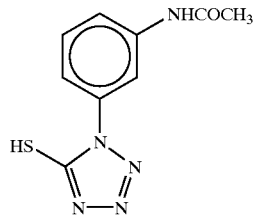

C-1

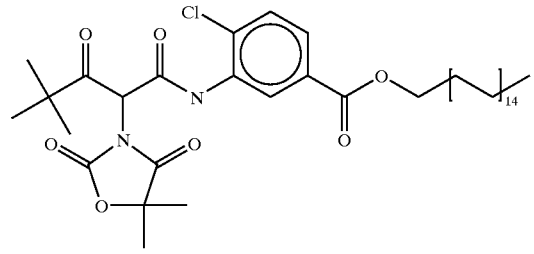

C-2

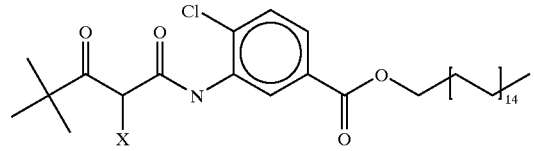

X =

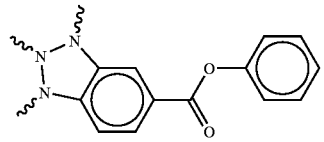

The iodide architecture of several different types of core/shell emulsions is described in Table 3. When these emulsions were chemically and spectrally sensitized and then treated with varying levels of FED 2, only one emulsion type gave exceptional speed gains as can be seen in Table 4. This emulsion type is distinguished by having only two distinct iodide regions or phases with a relatively low iodide in the core.

TABLE 3

| Emulsion | Grain Diameter μm | Total Iodide % | Number of Iodide Phases | % Iodide in Highest Phase |
|---|---|---|---|---|
| | Emulsion Characteristics | | | |
| E1 | 1.10 | 8.2 | 4 | 35 |
| E2 | 1.40 | 14 | 4 | 39 |
| E3 | 2.20 | 10.5 | 4 | 24 |
| E4 | 1.04 | 8.7 | 2 | 14 |

TABLE 4

| Example | Emulsion | FED 2 nmol/m$^2$ | D-min | D-min Change | Speed | Speed Change |
|---|---|---|---|---|---|---|
| | Photographic Performance | | | | | |
| 1 (comparison) | E-1 | 0 | 0.071 | | 300 | |
| 2 (comparison) | E-1 | 3.9 | 0.106 | 0.035 | 307 | 7 |
| 3 (comparison) | E-1 | 7.7 | 0.130 | 0.059 | 310 | 10 |
| 4 (comparison) | E-2 | 0 | 0.120 | | 285 | |
| 5 (comparison) | E-2 | 9.4 | 0.141 | 0.021 | 286 | 1 |
| 6 (comparison) | E-2 | 18.7 | 0.157 | 0.037 | 287 | 2 |
| 7 (comparison) | E-3 | 0 | 0.072 | | 270 | |
| 8 (comparison) | E-3 | 13.2 | 0.091 | 0.019 | 280 | 10 |
| 9 (comparison) | E-3 | 26.5 | 0.130 | 0.058 | 277 | 7 |
| 10 (invention) | E-4 | 0 | 0.100 | | 283 | |
| 11 (invention) | E-4 | 3.5 | 0.111 | 0.011 | 299 | 16 |
| 12 (invention) | E-4 | 7.0 | 0.124 | 0.024 | 304 | 21 |
| 13 (invention) | E-4 | 14.1 | 0.143 | 0.057 | 305 | 22 |

Note: Levels of FED 2 are expressed as the amount of active ingredient per unit surface area of emulsion. D-min is the minimum optical density measured in an unexposed region of the film. Speeds were measured as 100(1-logH) where H is the exposure in lux-sec necessary to produce a density 0.15 above D-min.

The invention has been described in detail with particular reference to certain preferred embodiments thereof, but it will be understood that variations and modifications can be effected within the spirit and scope of the invention.

What is claimed is:

1. A silver halide photographic element comprising at least one silver halide emulsion layer comprising a silver halide emulsion comprising polymorphic core/shell silver halide grains wherein the core region comprises silver bromide with from about 5 to about 20% silver iodide and the shell region comprises silver bromide with about 0.1 to about 10% silver iodide and said layer contains a fragmentable electron donor compound of the formula X—Y' or a compound which contains a moiety of the formula —X—Y'; wherein said fragmentable electron donating compound is of the formula

Q—X—Y'

$A—(X—Y')_k$ $(A)_k—X—Y'$ $Z—(X—Y')_k$

Or $(Z)_k—X—Y'$ wherein:

Z is a light absorbing group;

k is 1 or 2;

A is a silver halide adsorptive group;

Q represents the atoms necessary to form a chromophore comprising an amidinium-ion, a carboxyl-ion or dipolar-amidic chromophoric system when conjugated with X—Y';

X is an electron donor moiety, Y' is a leaving proton H or a leaving group Y, with the proviso that if Y' is H a base, β, is covalently linked directly or indirectly to X;

or said fragmentable electron donating compound being of the formula X—H or an electron donor which contains an —X—H moiety; wherein X is an electron donor moiety to which a base, $\beta^-$ is directly or indirectly covalently linked, H is a hydrogen atom;

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential<−0.7V.

2. A photographic element according to claim 1, wherein the core region comprises about 8 to about 18% silver iodide.

3. A photographic element according to claim 1, wherein the core region is about 20 to about 60% of the total grain volume.

4. A photographic element according to claim 1, wherein the core region is about 30 to about 50% of the total grain volume.

5. A photographic element according to claim 1, wherein the shell region comprises about 2 to about 8% silver iodide.

6. A photographic element according to claim 1, wherein Y' is:

(1) X', where X' is an X group as defined in structures I–IV and may be the same as or different from the X group to which it is attached (2)

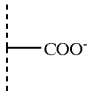

(3)

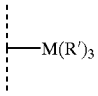

where M=Si, Sn or Ge; and R'=alkyl or substituted alkyl (4)

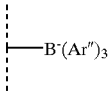

where Ar"=aryl or substituted aryl (5)

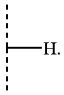

7. A photographic element according to claim 1, wherein said silver halide emulsion layer is contained in the blue record of color film.

8. A photographic element of claim 1 wherein the core region comprises silver bromide with from about 5 to about 24% silver iodide and the shell region comprises silver bromide with about 0.1 to about 5% silver iodide.

9. A photographic element of claim 1 wherein said polymorphic core/shell silver halide grains comprise no more than two iodide phases.

10. A photographic element according to claim 1, wherein the fragmentable electron donor compound is of the formula:

$$Z—(X—Y')_k$$

or $$(Z)_k—X—Y'$$

wherein Z is derived from a cyanine dye, complex cyanine dye, merocyanine dye, complex merocyanine dye, homopolar cyanine dye, styryl dye, oxonol dye, hemioxonol dye, or hemicyanine dye.

11. A photographic element according to claim 1, wherein the fragmentable electron donor compound is of the formula:

$$A—(X—Y')_k$$

or $$(A)_k—X—Y'$$

wherein: A is a silver-ion ligand moiety or a cationic surfactant moiety.

12. A photographic element according to claim 11, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

13. A photographic element according to claim 1, wherein the fragmentable electron donor compound is of the formula:

$$Q—X—Y'$$

wherein Q represents a chromophoric system comprising a cyanine, complex cyanine, hemicyanine, merocyanine, or complex merocyanine dye.

14. A photographic element according to claim 1, wherein the fragmentable electron donor compound is an ionic compound selected from the group consisting of:

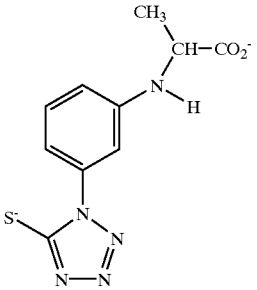

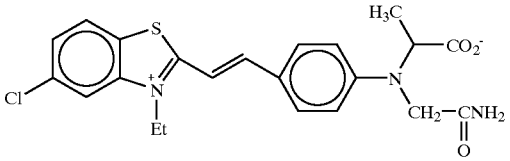

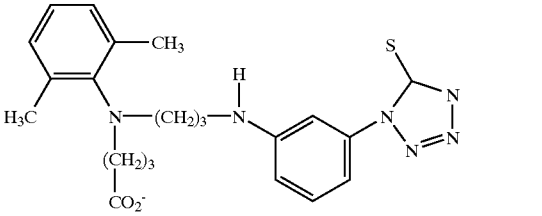

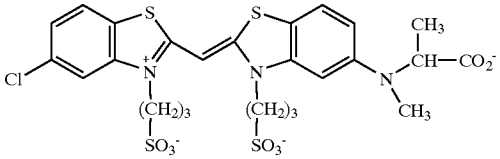

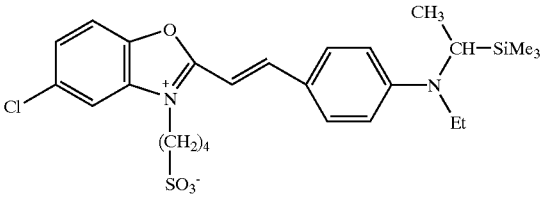

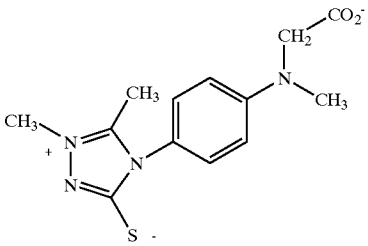

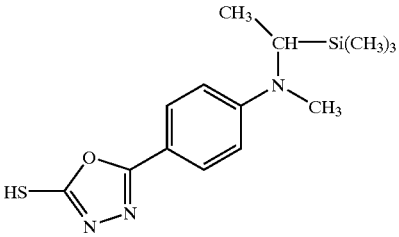

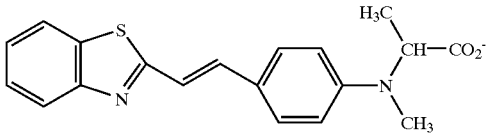

-continued

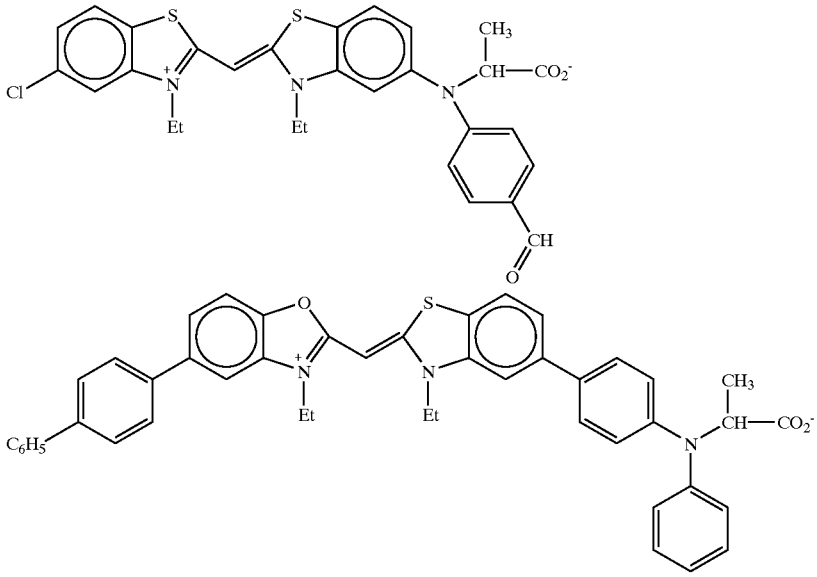

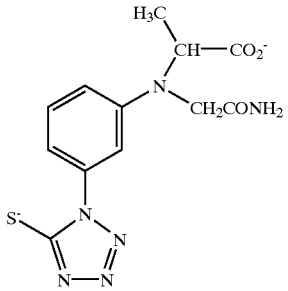

and

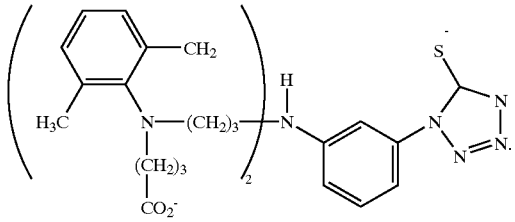

15. A photographic element according to claim 1, wherein X is of structure (I):

(I)

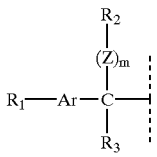

$R_1$ represents R, or a carboxyl, amide, sulfonamide, halogen, $NR_2$, $(OH)_n$, $(OR')_n$, or $(SR)_n$ group;

R' represents an alkyl or substituted alkyl group;

n=1 to 3;

$R_2$ represents R or Ar';

$R_3$ represents R or Ar';

$R_2$ and $R_3$ together can form a 5- to 8-membered ring;

m=0 or 1;

Z represents O, S, Se, or Te;

Ar represents an aryl group;

$R_2$ and Ar can be linked to form a 5- to 8-membered ring;

$R_3$ and Ar can be linked to form a 5- to 8-membered ring;

Ar' represents an aryl group; and

R represents a hydrogen atom or an unsubstituted or substituted alkyl group.

16. A photographic element according to claim 15, wherein the compound of Structure (I) is selected from:

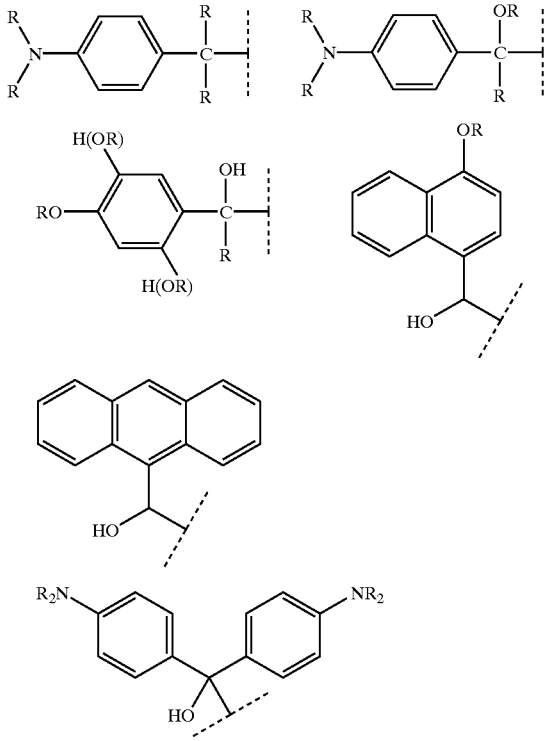

-continued

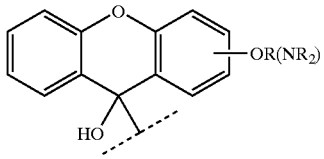

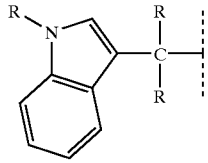

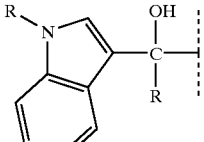

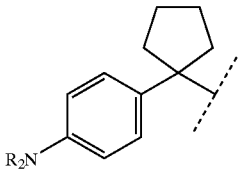

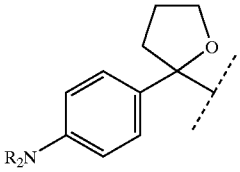

and

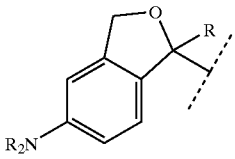

wherein each R is independently a hydrogen atom or a substituted or unsubstituted alkyl group.

17. A photographic element according to claim 1, wherein X is a compound of structure (II):

(II)

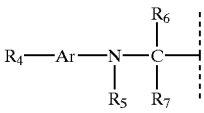

wherein:

Ar represents an aryl group or a heterocyclic group;

$R_4$ represents a substituent having a Hammett sigma value of −1 to +1;

$R_5$ represents R or Ar';

$R_6$ and $R_7$ represents R or Ar', or $R_6$ can be linked to Ar to form a 5- to 8-membered ring with Ar, in which case $R_6$ can be a heteroatom;

$R_5$ and Ar=can be linked to form a 5- to 8-membered ring;

$R_5$ and $R_6$ can be linked to form a 5- to 8-membered ring;

$R_6$ and $R_7$ can be linked to form a 5- to 8-membered ring;

Ar' represents an aryl group; and

R represents a hydrogen atom or an unsubstituted or substituted alkyl group.

18. A photographic element according to claim 17, wherein X selected from:

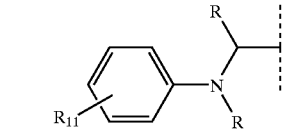

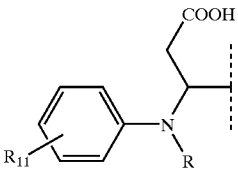

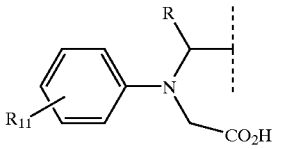

or

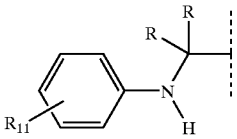

-continued

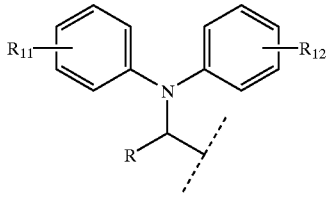

where $R_{11}$ and $R_{12}$ represent H or an alkyl, alkoxy, alkylthio, halo, carbamoyl, carboxyl, amido, formyl sulfonyl, sulfonamido, or nitrile group;

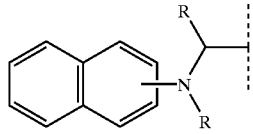

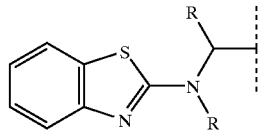

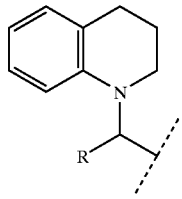

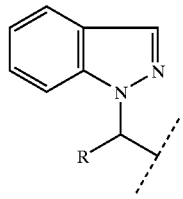

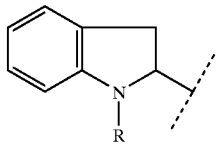

or

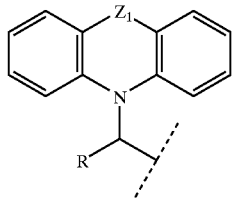

where $Z_1$ represents a covalent bond, S, O, Se, NR, $CR_2$, CR═CR, or $CH_2CH_2$; or

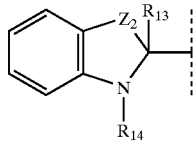

where $Z_2$ represents S, O, Se, NR, $CR_2$, or CR═CR, $R_{13}$, represents an alkyl, substituted alkyl or aryl group, and $R_{14}$ represents H, or an alkyl, substituted alkyl, or aryl group.

19. A photographic element according to claim 1, wherein X is a compound of structure (III):

(III)

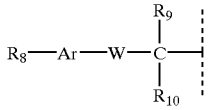

wherein:

W represents O, S, or Se;

Ar represents an aryl group or a heterocyclic group;

$R_8$ represents R, carboxyl, $NR_2$, $(OR)_n$, or $(SR)_n$ (n=1–3);

$R_9$ and $R_{10}$ represent R or Ar';

$R_9$ and Ar can be linked to form a 5- to 8-membered ring;

Ar' represents an aryl group; and

R represents a hydrogen atom or an unsubstituted or substituted alkyl group.

20. A photographic element according to claim 19, wherein X is selected from:

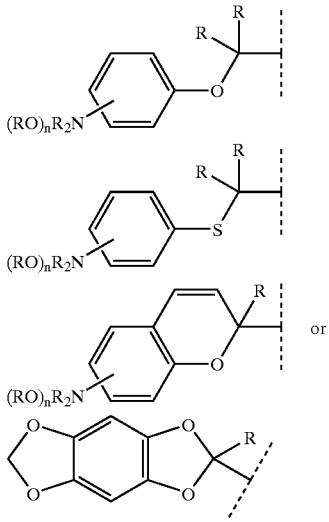

where n=1 to 3; and $(RO)_nR_2N$ indicates that either —OR or $NR_2$ is present.

21. A photographic element according to claim 1, wherein X is of structure (IV):

(IV)

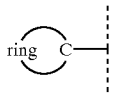

wherein:

"ring" represents a substituted or unsubstituted 5-, 6- or 7-membered unsaturated ring.

22. A photographic element according to claim 21, wherein X is selected from:

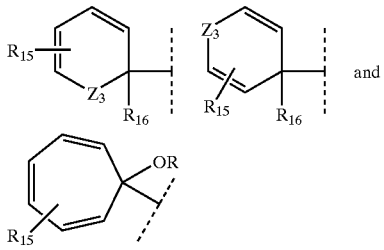

where $Z_3$ represents O, S, Se, or NR;

$R_{15}$ represents R, OR, $NR_2$;

$R_{16}$ represents an alkyl or substituted alkyl group; and

R is a hydrogen atom or an unsubstituted or substituted alkyl group.

* * * * *